United States Patent [19]

Hayashi et al.

[11] Patent Number: 4,825,533

[45] Date of Patent: May 2, 1989

[54] METHOD OF MAKING A VOICE COIL WITH RECTANGULAR COIL WIRE AND FOIL LEADS

[75] Inventors: Junkichi Hayashi; Tamotu Uchida, both of Saitama, Japan

[73] Assignee: Pioneer Electronic Corporation, Tokyo, Japan

[21] Appl. No.: 917,646

[22] Filed: Oct. 10, 1986

[30] Foreign Application Priority Data

Oct. 11, 1985 [JP] Japan ..... 60-224946
May 6, 1986 [JP] Japan ..... 61-103521

[51] Int. Cl.[4] ..... H01F 41/06
[52] U.S. Cl. ..... 29/605; 228/110; 336/192
[58] Field of Search ..... 29/605; 336/192, 208; 381/194; 83/23; 228/110

[56] References Cited

U.S. PATENT DOCUMENTS

| | | | |
|---|---|---|---|
| 2,714,173 | 7/1955 | Wieseman | 310/194 |
| 3,153,213 | 10/1964 | Stanwyck | 336/208 X |
| 3,196,523 | 7/1965 | Bell | 29/605 |
| 3,277,417 | 10/1966 | Rechel | 29/605 |
| 3,300,851 | 1/1967 | Lodder | 228/110 |
| 3,378,801 | 4/1968 | Smith, II | 29/605 |
| 4,109,375 | 8/1978 | Lin et al. | 29/605 |
| 4,258,467 | 3/1981 | Witte | 29/605 |
| 4,617,725 | 10/1986 | Holter et al. | 29/605 |

*Primary Examiner*—Carl E. Hall
*Attorney, Agent, or Firm*—Sughrue, Mion, Zinn, Macpeak & Seas

[57] ABSTRACT

A coil for a speaker in which a rectangular coil wire is formed by being cut from a sheet and then wound on the bobbin with its long direction disposed radially. Electrical connection is made to at least one end of the coil wire by ultrasonic welding to a conductive foil laid between the coil wire and the bobbin.

6 Claims, 5 Drawing Sheets

METHOD OF MAKING A VOICE COIL WITH RECTANGULAR COIL WIRE AND FOIL LEADS

BACKGROUND OF THE INVENTION

The present invention relates both to the shape of the wire used in winding a speaker coil and to the electrical connections to the coil wire.

A conventional speaker has the configuration shown in FIG. 1. A voice coil 8 is provided in such a manner that its axis cuts the magnetic lines of force generated by a magnetic circuit. A periodic electric current flowing through the coil 8 causes it to vibrate parallel to a center pole 4 in accordance with Fleming s rule. The center pole 4 is placed within a magnet 7. The vibration of the voice coil 8 is transmitted through a bobbin 3 to a diaphragm 6 which radiates sound waves that propagate through the air.

The most commonly employed voice coil 8 in a speaker has the winding arrangement shown in FIG. 2 wherein a round insulated wire is wound around a bobbin 3 to form a coil. The winding arrangement employed in another conventional type of voice coil is shown in FIG. 3 wherein a ribbon of insulated wire is wound around the bobbin 3 in such a manner the individual turns stand on end with respect to the bobbin.

Ribbons of insulated wire can be fabricated by two methods. In one method, round wires with an insulation coating in place are flattened with a roll mill, and in the other method, conductors rolled to a flat form are then coated with insulation coating. Whichever method is employed, a conductor 1 with an insulation coating 2 is wound around the bobbin 3 and both ends of the insulated wire are soldered to a selected area of the diaphragm 6 for establishing electrical connection to a power supply. The coil 8 is positioned within a magnetic gap 9 (see FIG. 1) formed between the center pole 4 and a top plate 5 and, responsive to a signal current, the coil 8 vibrates to drive the diaphragm 6 which then radiates sound waves into the air.

As shown in FIG. 2, a round insulated wire is typically wound in two layers rather than in a single layer. In order to achieve connection of the coil 8 to the diaphragm 6 at two terminals, one terminal lead of the coil 8 is folded back into the magnetic gap 9 but this requires a corresponding increase in the width of the magnetic gap 9, causing a reduction in the force driving the coil to vibrate. In order to avoid this problem, the wire which has been wound up as a single-layered coil is wound on the second layer in the opposite pitch direction so that the two terminal leads of the coil can be lumped on one side. This allows the wire to be wound up as a double-layered coil, which is equivalent to the doubling of the number of coil turns. This is why the round insulated wire is typically wound as a coil in two layers.

On the other hand, an insulated ribbon wire is wound in a single layer as shown in FIG. 3, and this is because the ribbon is very thin and can be folded back into the magnetic gap without necessitating a substantial increase in the gap width.

The force F of driving the voice coil 8 is expressed by:

$$F = B \cdot T \cdot I \cdot (N) \quad \ldots (1)$$

where B is the magnetic flux density generated by a magnetic circuit, T is the length of a conductor cutting the magnetic flux, and I is the current flowing through the voice coil. The term (N) is the number of turns of the conductor if T is calculated on a per turn basis.

In order to achieve greater vibration of the diaphragm in a speaker for a given amount of input current, the product of B and T must be increased without changing the weight of the voice coil.

The magnetic flux density B in a magnetic gap is expressed by:

$$B = (A_m \cdot B_d)/(A_g \cdot \delta) \quad \ldots (2)$$

where $A_m$ is the cross-sectional area of a magnet, $B_d$ is the magnetic flux density at the operating point of the magnet, $A_g$ is the cross-sectional area of the gap, and $\delta$ is the coefficient of magnetic leakage. The calculation of magnetic flux densities is largely empirical, but it is generally understood that the smaller the width and cross-sectional area of the magnetic gap, the greater is the density of the magnetic flux that is generated in the gap.

Equation (1) shows that the coil driving force F increases with increasing length of the conductor which cuts the magnetic flux.

The force F which is necessary to drive two types of voice coils, the one made of a round wire as shown in FIG. 2 and the other made of a ribbon wire as shown in FIG. 3, can be estimated as follows. Cross sections of the two types of insulated wire are depicted in FIGS. 4 and 5. In order to evaluate the value of the force F, the size of the magnetic gap which varies with the type of wire from which a voice coil is made must be calculated.

If the coil shown in FIG. 3 is assumed to have the same total resistance, the same total width, and the same number of turns as the coil shown in FIG. 3, the thickness of the ribbon, T, shown in FIG. 5 is expressed by:

$$T = D/2 + t \quad \ldots (3)$$

where t is thickness of the insulation coating and D is the diameter of the circular conductor. Since the cross-sectional area of the conductor is the same for both FIGS. 4 an 5, the widths of the two types of coil, $L_1$ and $L_2$, are calculated as follows:

$$L_1 = 2 \cdot (D + 2t) \quad \ldots (4)$$

$$L_2 = D \cdot (3 \cdot \pi + 4)/8 + t \quad \ldots (5)$$

If the diameter $D = 0.22$ and the insulation thickness $t = 0.005$, the respective values of $L_1$ and $L_2$ are 0.46 and 0.374. Since the value of $L_1$ is much greater than that of $L_2$, this large value is a significant factor in the calculation of the size of the magnetic gap and contributes to a lower coil driving force.

Although $L_2$ is smaller than $L_1$, the actual value of $L_2$ for the ribbon wire shown in FIG. 5 is so much greater than the idealized value that a satisfactory coil driving force is not attainable. As already mentioned, the manufacture of ribbon wires requires the rolling of round wires, irrespective of when this is effected before or after the application of an insulation coating. However, the rolling of round wires will inevitably introduce dimensional variances of $L_2$, which must be absorbed by providing a sufficiently large magnetic gap. In addition, the rolled wire is not completely flattened and is somewhat oval. The heat conduction between adjacent turns of a voice coil made of an oval wire is not much larger than when the coil is made of a round wire, so that localized heat generation is inevitable when the voice coil made of a ribbon wire is heated. Therefore, in order to avoid deterioration of the insulator coating at locally heated portions, care must be taken to supply the voice coil of a ribbon wire with electric power which is not substantially greater than that applied to the voice coil made of a round wire.

The voice coil wound around a bobbin and a lead to an amplifier are usually connected with each other at a position above the bobbin, or on the side of the diaphragm to which the bobbin is mounted. In order to attain a large magnetic flux, the voice coil around the bobbin is usually multi-layered. If the wire is wound as a coil in two or any even number of layers, there is no problem in terminating the winding operation since both terminal ends are pulled out of the coil to become exposed at the same upward end of the bobbin. However, if the wire is wound in an odd number of layers, the end of the wire at which its winding is terminated is exposed on the side which is opposite the side where the other end of the wire is exposed (i.e., at which position the winding operation has been started). In this case, the terminating end of the wire must be directed to a position upward of the bobbin by guiding the terminating end to run over the voice coil, or guiding it to run between the bobbin and the voice coil. Otherwise, it may be partly bonded to the inner wall of the bobbin and the remaining free portion is pulled upwardly of the bobbin. In whichever method is used, however, the magnetic gap must be widened by an amount which corresponds to the diameter or thickness of the terminating end of the wire that is folded back with respect to the voice coil, and this results in an unavoidable drop in the coil driving efficiency.

Several techniques have been proposed to solve the aforementioned problems; one is described in Japanese Patent Publication No. 21158/67. The leads from the voice coil disclosed in this patent are hereunder described with reference to FIG. 6, wherein a voice coil 42 is supported on a bobbin 41 which is either metallic or made of paper with a surface metal foil. A terminating end 42 of the coil 42 is soldered to the lower part of the conductive bobbin 41, while the other end **42*b* of the coil 42 at which the winding operation has been started is directly connected to a lead 43. Another lead 44 is soldered to the conductive bobbin 41. Also shown are a diaphragm 45 and a damper 46**.

In this coil arrangement, the bobbin 41 serves as part of the associated lead 44, and hence the aforementioned problem of an increased magnetic gap can be solved because there is no need to fold back the terminating end **42*a* of the voice coil 42. However, the method employed for joining the voice coil 42 to the bobbin 41 has the following disadvantages. If the voice coil 42 is made of an aluminum wire, as in the usual case, and is soldered to the bobbin 41**, the device cannot be operated at temperatures higher than 200° C. because the solder for joining aluminum wires melts at a temperature much below the point which the voice coil must withstand without failure (equal to or less than 300° C.). Joining between an aluminum coil and a copper lead presents a problem with device reliability because of the corrosive attack of the flux remaining after aluminum soldering or due to the moisture-initiated electrolytic corrosion that is caused by the difference in ionization potential B between the metals present in the solder alloy (i.e., Zn, Sn and Pb).

SUMMARY OF THE INVENTION

One object, therefore, of the present invention is to provide a voice coil that achieves high speaker driving efficiency and allows a large electrical input. The coil employs a rectangular conductor which has a minimum and ideal cross-sectional area. In addition, it can be manufactured with minimum dimensional variations from lot to lot so as to allow the use of a magnetic gap having minimum dimensions.

Another object of the present invention is to provide an improved connecting structure in a voice coil for an electro-acoustic transducer that features an enhanced resistance to heat and corrosion, which is achieved by using ultrasonic welding to join aluminum wires either to themselves or to copper wires.

The first object of the present invention can be achieved by employing the following procedures. A thin, broad strip of electroconductive material is slit into smaller widths having a rectangular cross section. Any burrs that remain on the narrow strips of conductor are removed. Each of the strips is then provided with an insulation and adhesive coating and wound onto a bobbin into a coil so that individual turns of the coil will stand on end with respect to the bobbin.

The second object of the present invention can be achieved by the following method. A pair of conductive foils are formed on the surface of a bobbin. An insulated wire is wound around the bobbin to form a coil, with the winding operation being started and terminated on the surfaces of the foils. The terminal ends of the coil are joined to the conductive foils by ultrasonic welding.

DESCRIPTION OF THE PREFERRED EMBODIMENTS

Figure 7:
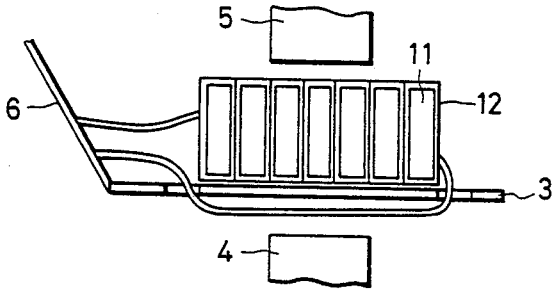
FIG. 7 is an enlarged sectional view showing the essential parts of a voice coil featuring the first aspect of the present invention.

A first preferred embodiment of the voice coil of the present invention in accordance with its first aspect is hereunder described with reference to FIG. 7.

The voice coil is constructed with a conductor 11 having a rectangular cross section. The conductor 11 is obtained by slitting a thin, broad strip of conductive material into equal widths. Any burrs produced in the slitting operation are removed either mechanically (e.g., with rotary brushes) or chemically (e.g., by etching). The deburred strip is coated with an adhesive insulation coating 12 that will enable individual turns of the conductor 11 to adhere to one another while they are insulated from each other. The other components shown in FIG. 7 are a bobbin 3, a center pole 4 which forms a magnetic gap with a top plate 5, and a diaphragm 6. At a selected area of the diaphragm, the starting and terminating ends of the conductor 11 are connected to a power supply by appropriate means, such as soldering.

The width of the coil ($L_3$ in FIG. 14) that is formed by winding the conductor 11 around the bobbin 3 can be calculated by the following equation, assuming the same conditions for calculation of $L_1$ and $L_2$:

$$L_3=\pi\cdot D/2+t \quad \ldots (6)$$

Figure 2:
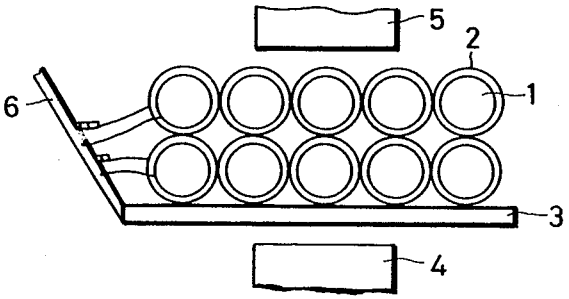
FIG. 2 PRIOR ART
FIG. 2 and 3 are enlarged sectional views of a conventional speaker showing the portion corresponding to the area depicted in FIG. 7.
Figure 3:
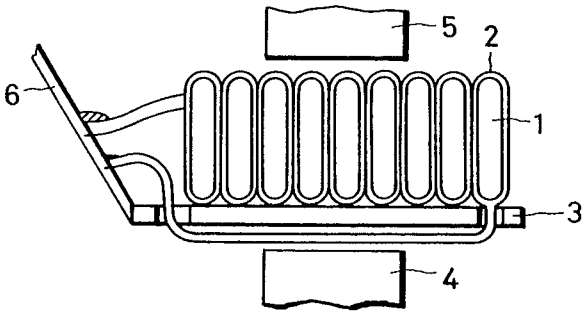
FIG. 3 PRIOR ART
Figure 1:
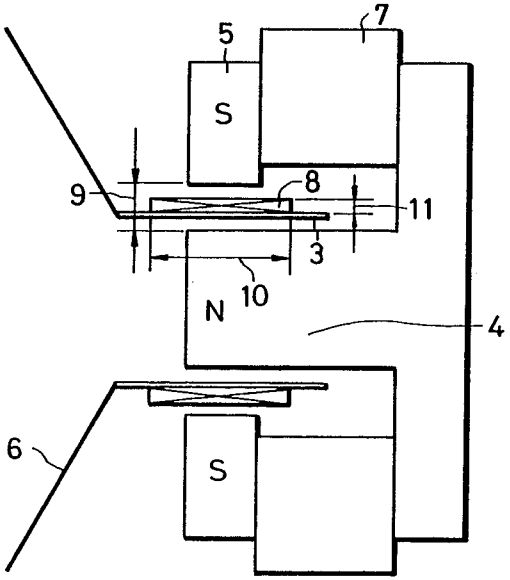
FIG. 1 PRIOR ART
FIG. 1 is a cross section of the voice coil in a speaker.
Figure 4:
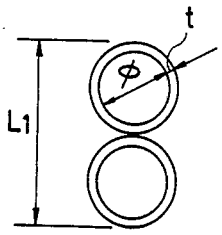
FIGS. 4, 5 and 14 show in cross section the insulated wires employed in the voice coils shown in FIGS. 2, 3 and 7.
Figure 5:
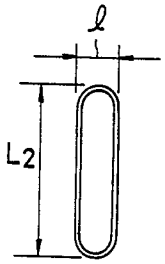

If $D=0.22$ and $t=0.005$ as in FIGS. 4 and 5, $L_3$ is calculated to be 0.351, which is about 7% smaller than $L_2$ in FIG. 5, which means that the width of the magnetic gap can be reduced by a corresponding amount.

Since the rectangular conductor is formed by slitting a thin, broad strip of conductive material, it is free from the variations that may occur in its width and thickness during manufacture and eliminates the need for providing enough gap for the ribbon wire to allow for such variation.

An example of the process for producing a voice coil in accordance with the first embodiment of the present invention is hereinafter described with reference to FIGS. 8 to 12.

Figure 8:
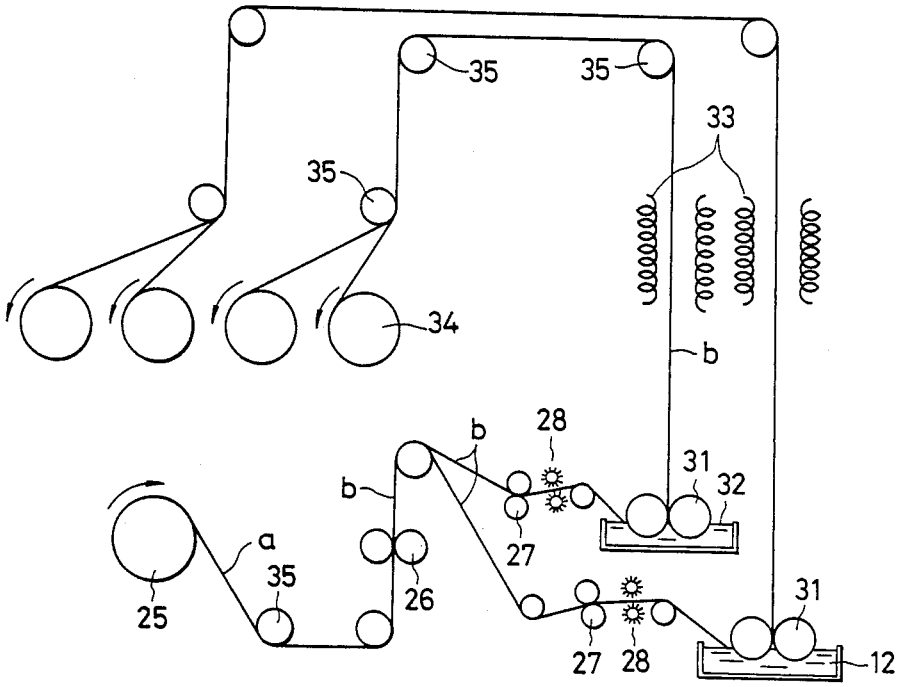
FIG. 8 is a schematic illustration of the process for producing with a slitter/applicator unit an insulated wire that is to be used in making a voice coil in accordance with a first embodiment of the present invention.

Broad copper foil a that has been taken up by a bulk roll after it has been rolled to a given thickness, for instance, within the range of 10–20 μm, is then rewound onto a delivery reel 25 included in a slitter/coater apparatus of the type shown in FIG. 8. The foil a is delivered from the reel 25 at a speed of 20–50 m/min and guided by a roller 35 to be fed into a slitter 26.

Figure 9:
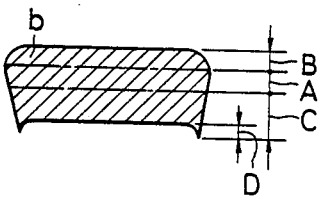
FIG. 9 depicts a cross section of a thin strip of conductor that is obtained by slitting a broad strip.
Figure 10:
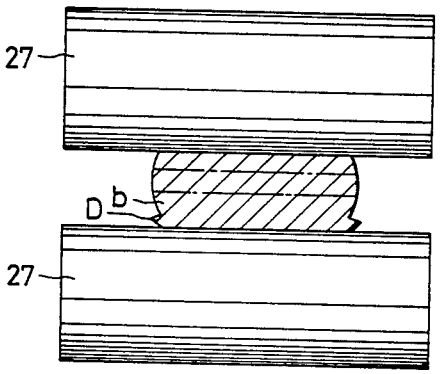
FIG. 10 is a front view of pressure roll used to deburr the thin strip shown in FIG. 9.
Figure 13:
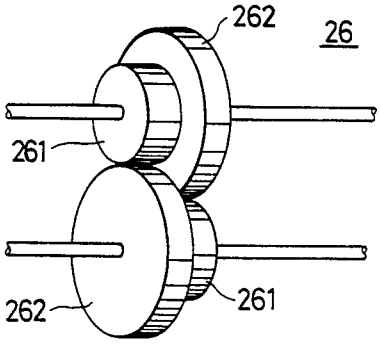
FIG. 13 is a diagram showing a slitter used with the invention.

The slitter 26 is composed of two pairs of rolls each consisting of a small disk 261 and a large disk 262 having the same width. As shown in FIG. 13, the small disk 261 in one roll pair engages the large disk 262 in the other roll pair. The copper foil a which is fed between the two rolls is slit into two halves under the shearing action exerted by the two large disks 262. As shown in FIG. 9, the cross-section A of a sheared strip b has sags B in the upper portion and a fractured face C has downwardly projecting burrs D whose height typically ranges from about 1 to 2 μm.

If the strip b with burrs D is coated with an insulation layer and subsequently wound onto the bobbin to form a coil, the insulation coating may be broken to potentially cause shorts between adjacent turns of the coil. In addition, the projecting burrs D create an empty space between adjacent turns of the coil that corresponds to their height, causing a drop in the space factor of the conductor or incomplete adhesion between individual conductor layers. In order to avoid this problem, the two narrow strips b emerging from the slitter 26 are guided into two pressure roll units 27, with one strip coming to one pressure roll unit 27 while the other strip is fed to the other respective roll unit 27. Each strip b is compressed between the two rolls of the respective pressure roll unit 27. As a result of this compression, the downwardly projecting burrs D are collapsed laterally and the base of each burr becomes brittle.

Figure 11:
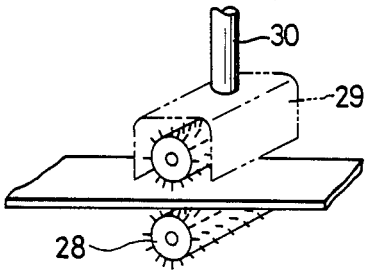
FIG. 11 is a perspective view of rotary brushes used to clean the surface of the deburred strip.
Figure 12:
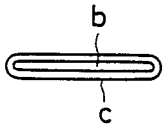
FIG. 12 is a cross section of a thin strip provided with an adhesive insulation coating.

In the next step, the strip b is fed into the space between two rotary brushes 28 and the embrittled burrs D are sheared off the strip b under the frictional force exerted by the rotating brushes. As shown in FIG. 11, each of the brushes 28 is covered with a casing 29 which is connected to a suction pipe 30 that sucks in the shed burrs which, if left unremoved from the strip, will cause various undesirable effects.

The deburred strips b are then fed into respective baths 32 filled with insulation paint. As each strip b is guided with a roll coater 31 consisting of two rolls having an adjustable inter-roll gap, all surfaces of the strip b, including cut ends thereof, are provided with a predetermined thickness of a paint. The insulation paint may be formulated from polyurethane, polyamide or other resins that have electrically insulating properties and which will maintain adhesiveness upon heating.

The strip b with an adhesive and insulating coating c is passed through a heater 33 such as an infrared or far-infrared heater, where the insulation coating c is dried and heat-set so that individual layers of the coating c will not stick to each other during the subsequent winding operation. The strip with the dried insulation coating is guided with rollers 35 so that it is wound up by take-up reels 34. Alternative take up reels may be provided to facilitate production. If voice coils having enhanced insulating and adhesive properties are needed, a thermosetting resin and a heat-softening resin may be applied to form a multi-layered insulation coating.

The take-up reels onto which the strip b with the insulation coating c has been wound up is then mounted in a coil winding machine wherein the strip b is wound around a bobbin to make a voice coil. In order to ensure enhanced coil shape retention or insulation at the coil edges, the edges of the strip b may be provided with another adhesive and insulating coat. Once the strip b has been wound on the bobbin, the bobbin may be heat treated to set the adhesiveness of the insulating adhesive. Of course the strip b needs to be cut, either before or after winding, to provide both terminal ends.

If the magnetic gap width and the total resistance and weight of coil are the same, the voice coil fabricate in accordance with the embodiment described above permits the use of a smaller-diameter bobbin and yet provides an increased number of coil turns.

Figure 14:
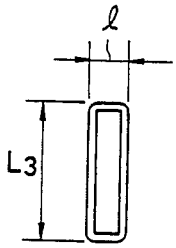

As shown in FIG. 14, the opposite sides of the insulated conductor strip used in the present invention have a high degree of parallelism, so that the individual turns of the voice coil fabricated by winding this strip provide sufficiently good heat conduction to avoid local concentration of the heat generated upon heating of the coil. This decreases the chance of the insulation coating becoming thermally degraded and permits a greater electric power to be applied than when the voice coil is made of the winding of a round or oval insulated wire of the type shown in FIG. 4 or 5.

The voice coil fabricated in accordance with the first embodiment of the present invention allows the diameter of a bobbin and, hence the size of a magnet, to be reduced without changing the magnetic flux density B or the length T of a conductor that cuts the magnetic flux. For instance, a voice coil made of the winding of a round wire conventionally requires the use of a bobbin having a diameter of 35 mm, but in accordance with the embodiment described above, the bobbin diameter can be reduced to 20 mm without changing the cross-sectional area of the conductor employed. As a result of this reduction in bobbin diameter, the size of the magnet needed is sufficiently reduced to realize a substantial reduction in the price of the speaker as the final product.

The embodiment described above assumes the use of a cone-shaped diaphragm 6, but it should be understood that equally good results are attainable by the present invention even if the diaphragm is horn-shaped, dome-shaped or fabricated in any other conventional shape.

The voice coil of the present invention has a cross-sectional width $L_3$ which is much smaller than what has heretofore been used, and it can be fabricated without winding the insulated wire in two layers. In addition, each turn of the diameter or width of the coil introduced by the folding back of the terminating end of the wire is negligibly small. The use of a slitter in the making of individual conductor strips eliminates any variations in the width $L_3$ that may be introduced during manufacture, so that the magnetic gap width can be determined without allowing for such variations. The smallness of the cross-sectional width $L_3$ of the strip has the additional advantage of minimizing the magnetic gap width to thereby increase the speaker driving efficiency. On the other hand, given the same magnetic gap width, a smaller-diameter voice coil can be attained without degrading the insulation of the wire. Since this permits the use of a smaller magnet, the overall cost of the speaker can be significantly reduced.

Figure 6:
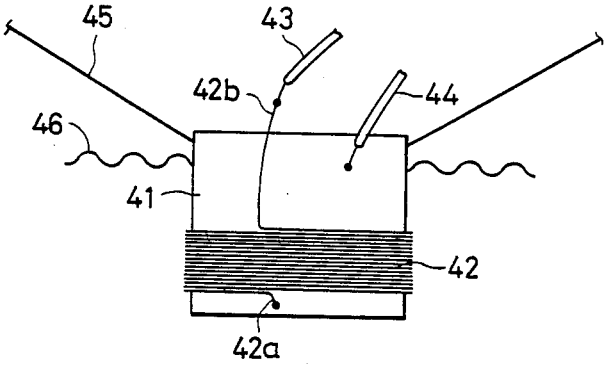
FIG. 6 PRIOR ART
FIG. 6 is a front view showing connecting structure of the prior art.
Figure 15:
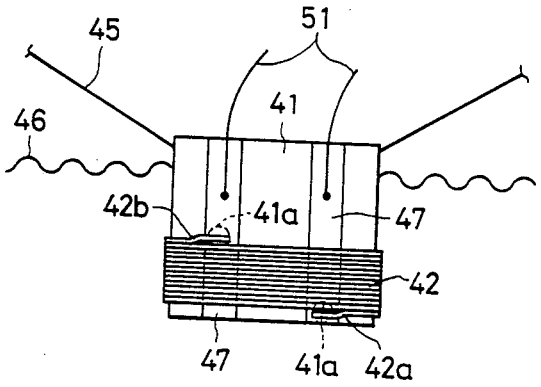
FIG. 15 is a front view showing a connecting structure according to second embodiment of the present invention.
Figure 16:
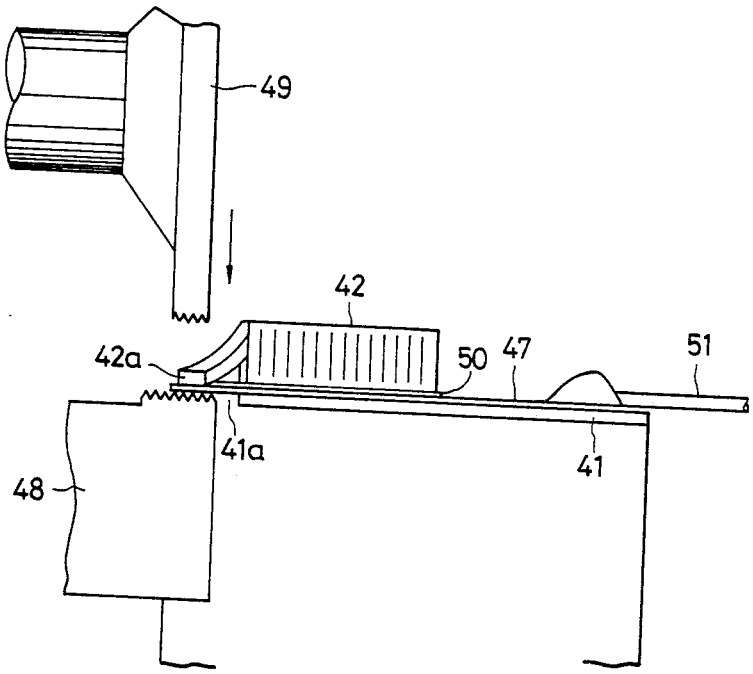
FIG. 16 is a schematic diagram showing how the structure depicted in FIG. 15 is attained.

The method of connecting a voice coil to a bobbin in accordance with the second embodiment of the present invention is hereunder described with reference to FIGS. 15 and 16, wherein the components which are the same as those shown in FIG. 6 are identified by like numerals and will not be described in detail.

The above-described method will be described below in more detail with reference to FIG. 16. First, circular, square or otherwise shaped holes 41*a* are formed in the bobbin 41 at the areas where the ends 42*a* and 42*b* of a voice coil to be formed will join with the conductive foils 47. In the next step, a ribbon or round wire of aluminum, copper or other appropriate metallic materials that includes an adhesive insulation coating is wound around the bobbin to make the coil 42. A pressure-receiving table 48 of an ultrasonic welding unit is inserted into each of the holes 41*a* from beneath the coil 42 until the table 48 makes direct contact with the underside of the conductive foil 47 lying just above the hole 41*a*. With the terminal end 42*a* (42*b*) being placed in contact with the surface of the conductor 47 at the area corresponding to the hole 41*a*, an oscillator head 49 of the ultrasonic welding unit is lowered until it contacts the terminal end 42*a* (42*b*). Thereafter, the oscillator 49 is actuated to apply both pressure and vibration to the terminal 42*a* (42*b*) so that the coil 42 is ultrasonically welded to the conductive foil 47.

It should of course be noted here that before performing ultrasonic welding, both terminal ends 42*a* and 42*b* of the coil 42 are stripped of the adhesive insulation coating. A sheet of insulating paper 50 is provided between the coil 42 and the bobbin 41 to which the conductor foils 47 have been attached and this paper ensures electrical insulation between the foils 47 and the coil 42. The mating surfaces of the table 48 and the oscillator head 49 are knurled or otherwise surface worked to provide anti-slip properties.

After the voice coil 42 has been connected to the bobbin 41 by the method described above, lead wires 51 may be soldered to the upper part of the conductor foils 47 to which the terminal ends 42*a* and 42*b* have been welded. This eliminates the need for folding back the terminating end 42*a* as in the prior art, and hence the unwanted increase in the diameter of the coil 42 is precluded. Ultrasonic welding of the terminal ends 42*a* and 42*b* has the additional advantage of preventing the occurrence of corrosion due to the flux used in soldering these terminal ends or the development of electrolytic corrosion due to the different ionization potential of the metal components present in the solder alloy.

As described above, the method of connecting a voice coil to a bobbin in accordance with the second aspect of the present invention is characterized by first attaching conductive foils to the surface of the bobbin, then winding an insulated wire around the bobbin to form a coil, and finally joining by ultrasonic welding the terminal ends of the coil to the conductive foils. Since this method does not employ soldering to join the voice coil to the bobbin, it is free from the following disadvantages associated with the use of solder:

(1) corrosion due to the flux that remains after soldering;

(2) separation from the voice coil of the low-temperature melting solder which is used in soldering aluminum wires; and (3) electrolytic corrosion which occurs owing to the differential ionization potential between metallic components present in the solder alloy.

While a second embodiment of the present invention as applied to the voice coil of a speaker has been described above, it should be understood that the method according to this embodiment can also be applied to connecting lead wires to voice coils in other dynamic electroacoustic transducers such as microphones.

What is claimed is:

1. A process of fabricating a coil, comprising the steps of:

slitting a thin, broad sheet of electrically conductive material into a plurality of strips having a substantially rectangular cross section and having widths smaller than a width of said sheet, said rectangular cross section having a longer side longer than a shorter side;

pressure rolling each said strip for collapsing burrs formed by said slitting step and rendering them brittle and providing a more rectangular cross section;

removing said burrs from the rolled strips;

depositing an adhesive insulating coating on at least one surface of each of said strips after said burrs have been removed; and winding one of said strips deposited with said coating onto a bobbin to form a coil of predetermined shape and of a predetermined number of turns, successive turns of said strip facing each other along said longer side of said rectangular cross section.

2. A process as recited in claim 1, further comprising the step after said winding step of activating said adhesive insulating material, whereby successive turns of said strip formed into said coil adhere to one another and are electrically insulated from each other.

3. A process as recited in claim 2, wherein said activating step comprises heating said formed coil.

4. A process as recited in claim 1, further comprising the step, prior to said winding step, of forming two conductive foils extending axially on an outer surface of said bobbin, and wherein, in said winding step, said strip is wound in a circumferential direction of said bobbin over a length of said conductive foils.

5. A process as recited in claim 4, further comprising the step of ultrasonically welding two terminal ends of said strip formed into said coil to respective ones of said conductive foils.

6. A process of fabricating a coil, comprising:

forming two conductive foils extending axially on an outer surface of a bobbin;

winding an insulated electrical wire around said bobbin only in an area in which said two foils are formed to form a coil; and ultrasonically welding two terminal ends of said wire formed into said coil to respective ones of said conductive foils by disposing a welding head inside of said bobbin facing said wound strip and one of said foils through an aperture in said surface.

* * * * *